US006074130A

United States Patent [19]

Duran

[11] Patent Number: 6,074,130

[45] Date of Patent: Jun. 13, 2000

[54] INSIDE DROP SYSTEM FOR MANHOLES

[75] Inventor: Lee A. Duran, Lyme, Conn.

[73] Assignee: Duran, Inc., Lyme, Conn.

[21] Appl. No.: 09/160,940

[22] Filed: Sep. 25, 1998

[51] Int. Cl.[7] ..... E02D 29/12

[52] U.S. Cl. ..... 405/53; 405/36; 404/2; 52/20; 285/179.1; 137/372

[58] Field of Search ..... 285/179.1, 179.2; 405/36, 41, 53, 39, 40; 404/2, 3, 4; 137/363, 364, 372; 52/20, 21

[56] References Cited

U.S. PATENT DOCUMENTS 1,005,371 10/1911 Union ..... 404/4
1,341,870 6/1920 Woock ..... 137/372
1,816,670 7/1931 Church ..... 285/179.1
5,402,848 4/1995 Kelly ..... 52/20

*Primary Examiner*—David Bagnell
*Assistant Examiner*—Frederick L. Lagman
*Attorney, Agent, or Firm*—St. Onge Steward Johnston & Reens LLC

[57] ABSTRACT

A manhole drop system is described which is convenient to inspect. A catch bowl made of an integral structure is formed to capture and channel sewer fluid entering a manhole an elevation that is above a bottom located sewer line. The catch bowl has its upper portion shaped to reveal both a lower exit port leading to down drain and to reveal the discharge opening from a side feed. The catch bowl has a front surface that is curved sufficiently to enable a relatively secure seal between the front surface and a curved wall of the manhole.

7 Claims, 3 Drawing Sheets

INSIDE DROP SYSTEM FOR MANHOLES

FIELD OF THE INVENTION

This invention relates to manholes generally and to an inside drop system for manholes more particularly.

BACKGROUND OF THE INVENTION

Typically, street manholes are collection points for various sewer conduits converging on the manhole to disgorge their contents into a main line located at the bottom of the manhole. The manholes can be of many shapes and sizes, but typically are round in cross-section and have an opening at the top sufficient to enable a person to enter and do the appropriate service that may be required. The manhole frequently serves as a junction point where different sewer lines are joined to merge into a common discharge conduit in a manner, for example, as described in my U.S. Pat. No. 5,553,973.

The feed-in of discharge fluids from adjacent areas frequently enter a manhole at a higher level than the bottom located sewer line. The feed-in pipe then projects a small distance into the manhole to deliver a stream of discharge liquid into the middle of the manhole. Entry into the manhole then is impeded by this extended stream. Manhole drops have, therefore, been devised to provide a channel alongside the wall of the manhole for the sewer feed that comes in from the side. Such conventional manhole drop has an inlet pipe that extends into the manhole to a T shaped pipe as illustrated in FIG. 1 herein. one end of the T is plugged and the downwardly directed portion is coupled to a pipe that channels the side feed liquid down to the sewer line.

Typically the inside drop system has to be matched to the incoming feed line with a comparable pipe size. Since each feed pipe material has different measurement system and attachment system there would have to be an equal number of fittings or custom parts would have to be made up of sheet material. For smaller feed pipes a frequent solution involved the use of an inside drop pipe that is relatively large in cross-section and this is matched to the incoming feed line by simply cutting a hole into the drop pipe. This, of course meant that the entire drop pipe has to be removed to allow an inspection and cleaning of the incoming side feed line.

One problem with the conventional system of FIG. 1 is that it does not permit easy inspection of the feed line or of the drop itself. To see the feed line requires removal of the plug and the inside part of the drop is not visually accessible from above. These problems are eliminated with a drop system in accordance with the invention.

SUMMARY OF THE INVENTION

With a manhole drop system in accordance with the invention visual inspection of the inside drop system can be done from above at the entrance to the manhole. Visual inspection of the feed pipe can be done without having to remove a plug and is conveniently and rapidly accomplished.

This is achieved with an inside drop system in accordance with the invention by employing an inside drop system so that it is independent from the incoming pipe size. This achieved by recognizing that the incoming fluid does not have to make continuous contact with a conduit in order to control its path. The inside drop system of this invention is, therefore, separated from the incoming feed line so that the inside drop system can be sized and shaped in a uniform manner independent from the physical constraints of the incoming feed pipe.

One inside drop system in accordance with this invention includes an integral catch bowl which has a fluid retaining wall around a bottom located exit port leading to the sewer at the bottom of the manhole. The front surface of the fluid retaining wall is shaped to conform to a portion of the manhole wall at the entry point for the side feed as well as to expose the side feed and the exit port for visual inspection. The catch bowl is open from the top and rear to facilitate visual inspection and is made of a corrosion resistant material to enhance its installation, maintenance and use.

The selection considerations for the inside drop system is based upon the expected volume of flow and its characteristics whereby the inside drop system is sized for volume capacity and the bowl shape and its location relative to the discharge opening of the incoming feed pipe selected fo the volume of the flow, its velocity and contents. As a result standard collectors and drop pipe sizes can be used to service a broad range of pipe sizes and types.

It is, therefore an object of the invention to provide an inside drop system for a manhole that is easy to install and use and facilitates maintenance of the system and associated connected parts. It is a further object of the invention to provide an inside drop system for a manhole which can be inspected and cleaned without entering the manhole structure.

These and other advantages and objects of the invention can be understood from the following detailed description of a preferred embodiment as illustrated in the drawings and described below.

DETAILED DESCRIPTION OF THE DRAWINGS

Figure 1:
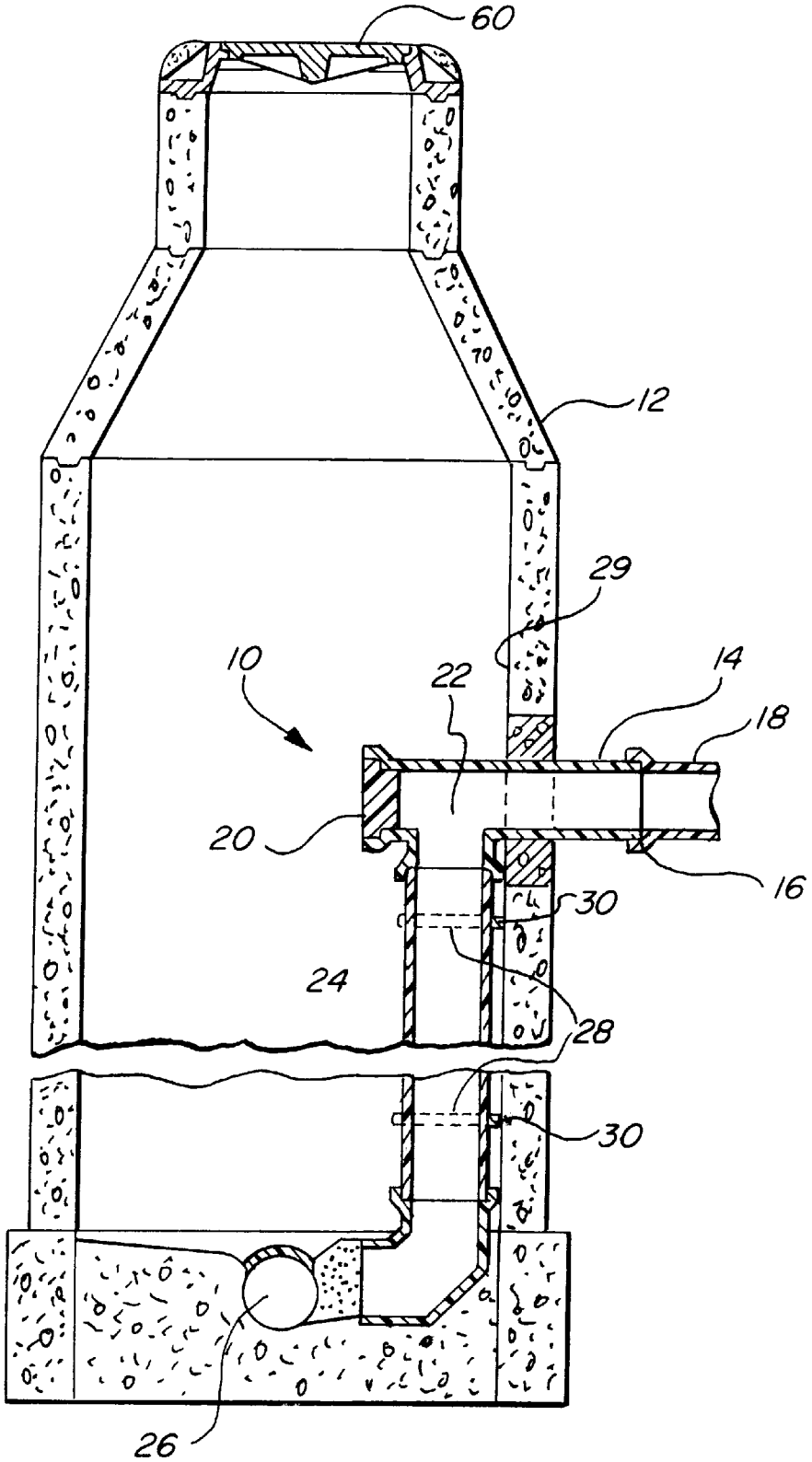
FIG. 1 ( PRIOR ART )
FIG. 1 is side section in elevation of a prior art drop system for a manhole.
Figure 3:
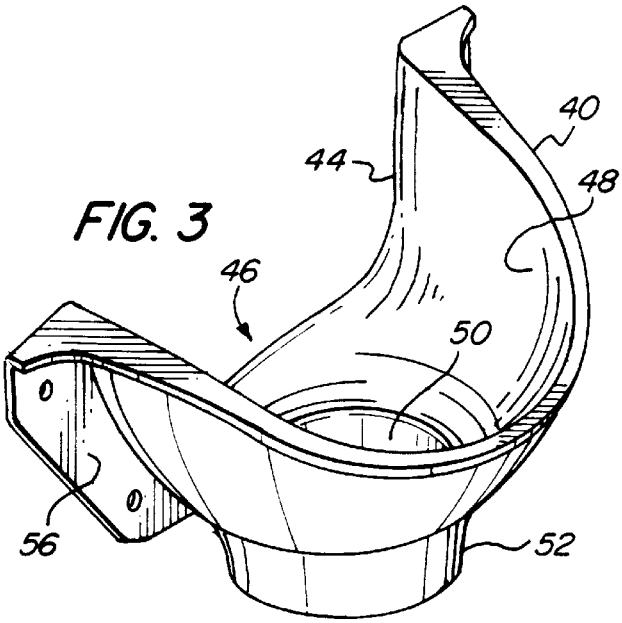
FIG. 3 is a perspective view of a catch bowl for use in the drop system of FIG. 1.

With reference to FIG. 1 a prior art drop system 10 for a manhole 12 is shown. The drop system includes an inlet duct 14 attached at 16 to a side feed 18. The inlet duct extends into the manhole and is terminated at an inner end by a plug 20 and has an exit port 22 that leads into a drain pipe 24 which terminates at a bottom located sewer line 26. Attachments 28 are provided to maintain the drain pipe alongside the inner wall 29 of the manhole but spaced therefrom by appropriate spacers 30.

In a drop system in accordance with the invention as shown, for example, in FIGS. 2–7, a catch bowl 40 is used right below an inner extending portion 42 of the side feed 18 and its discharge opening 43. This inner portion terminates a few inches past the inner wall 29 and does not require an extensively mortared inlet port of the manhole. The catch bowl 40 has a front surface 44 which is contoured or shaped to generally conform to the curvature of the inner wall 29 of the manhole 12 at the side feed 18 entry place as more clearly shown in FIG. 6. The catch bowl 40 has a front opening 46, a fluid retaining wall 48 around its perimeter and a bottom located exit port 50 in a downwardly extending segment 52 which can be affixed to a drain pipe 54.

The catch bowl is sized and shaped to capture liquid draining from the side feed and channel it down to the bottom located hemispherical open flume 26 coupled to a sewer line, not shown. The retaining wall 48 is, therefore, so sized and shaped to receive the various low and high flows from the side feed 18.

The front surface of the catch bowl 40 is provided with a flange 56. The flange 56 is curved to conform with the curvature of the manhole wall 29 below the side feed segment 42. The curvature of manholes and the surface irregularities of wall may cause a mismatch with the curvature of the front surface 44 and flange 56. The match need not be exact since bolts 58, used to attach the catch bowl 40 to the wall 29, can be drawn sufficiently tight to force the front surface into intimate contact with the wall 29. Generally, a particular catch bowl 40 can be matched to a range of different diameter manhole walls 29.

The catch bowl 40 can be made as an integral singular molded piece that is made from a suitable corrosion resistant plastic such as PVC or polyethylene or resin impregnated fiberglass or the like. the catch bowl is shown as curved. However, other shapes could be used such as rectangular or other shapes suitable for separating the drop pipe 54 from the incoming side feed line 18 while still being able to catch and then channel the effluent from the side feed 18 discharge opening 43.

A particular advantage of the manhole drop system of this invention is that a visual inspection of the drain pipe and side feed effectiveness can be checked from above at the upper opening 60, see FIG. 1, of manhole 12 so that a person need not always have to enter the manhole to check.

Figure 7:
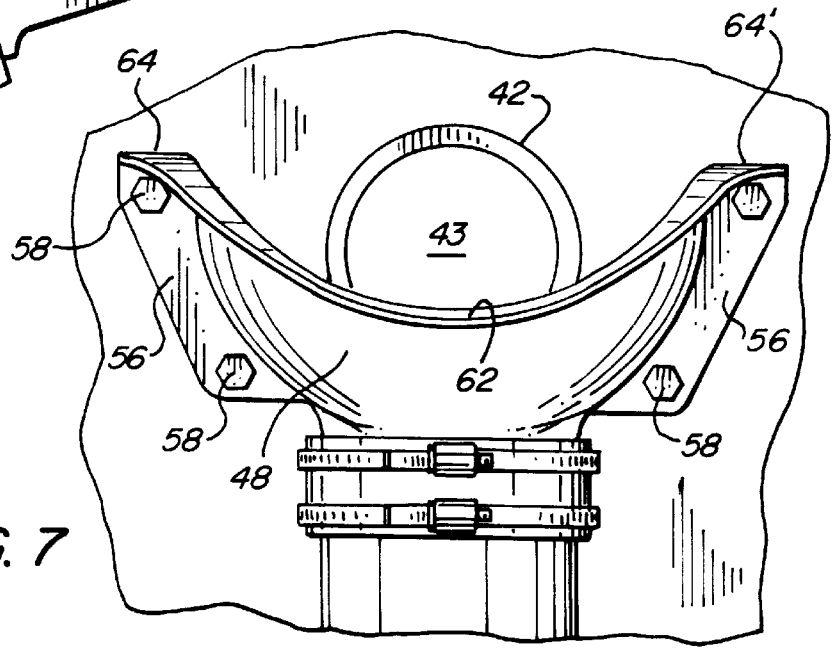
FIG. 7 is a partial enlarged front view of the upper end of the drop system of FIG. 1.

The fluid retaining wall 48 is further so shaped that it has a rearward portion 62 that is sloped down from upper side ends 64, 64' to reveal the side feed segment 42 as illustrated in FIG. 7. Hence, an inline inspection of side feed 18 can be carried out without having to remove a plug such as 20 shown in use on a prior art drop system 10 in FIG. 1. This would then advantageously reduce the time a maintenance worker would have to spend inside the manhole 12 to inspect the side feed 18 and permit direct physical and visual communication with cleaning tools and use of a video camera.

Attachment of the catch bowl 40 to down drain pipe 54 can be done with a flexible coupling 66, which can be a conventional external pipe coupler, or other suitable fastener. The drain pipe 54 preferably is made sufficiently long to deliver fluid into the bottom located open flume 26. The attachment of the catch bowl 40 to the wall 29 of the manhole need not involve a flange 56 and could employ a strap that is anchored to wall 29 or another suitable fastener.

Figure 4:
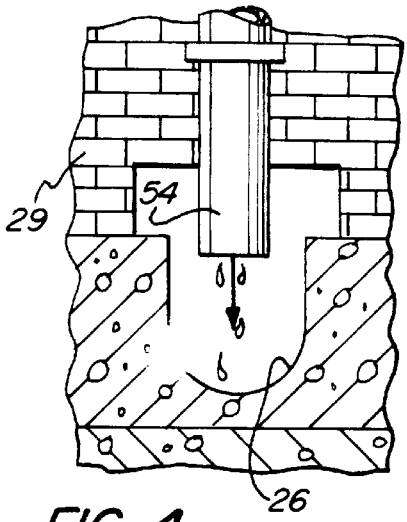
FIG. 4 is a partial front view of the lower end of the drop system of FIG. 1.
Figure 2:
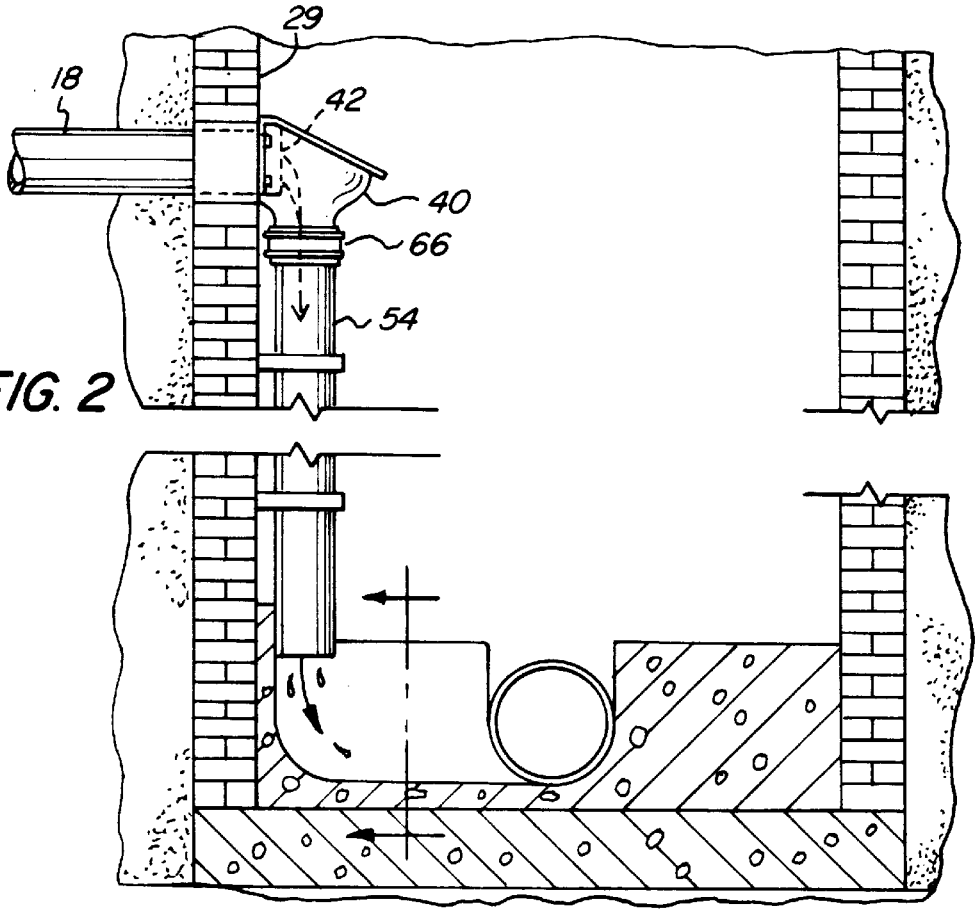
FIG. 2 is a section view in elevation of a manhole drop system in accordance with the invention and as it is installed inside a manhole.
Figure 6:
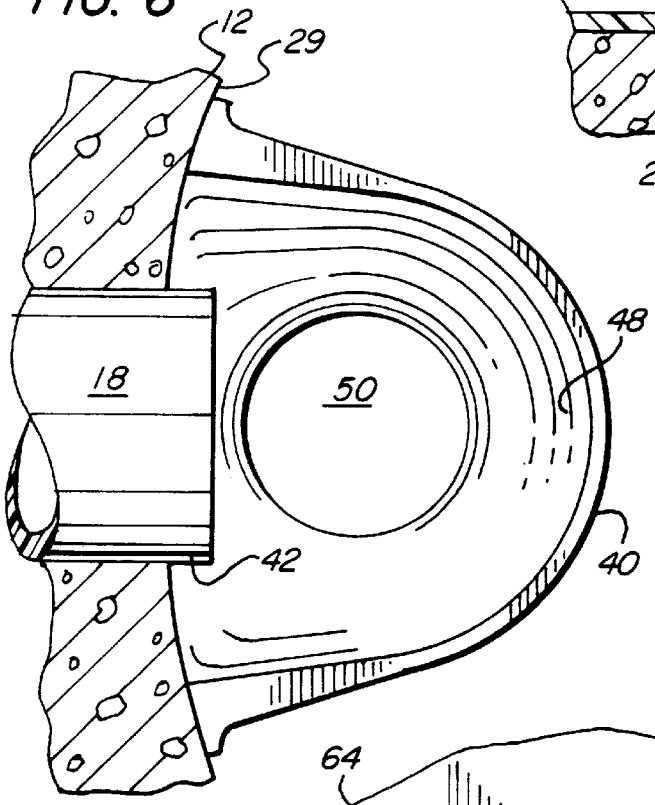
FIG. 6 is an enlarged top view of the drop system of FIG. 1.
Figure 5:
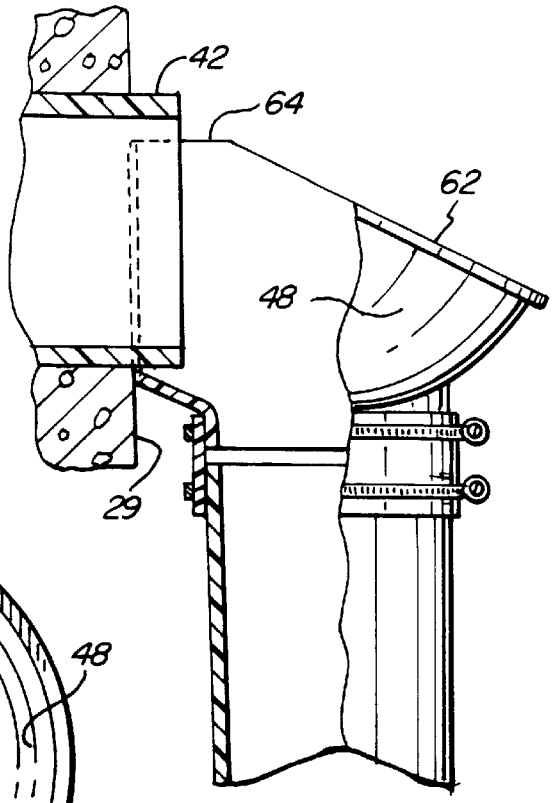
FIG. 5 is an enlarged partial side view in elevation of the upper end of the drop system of FIG. 1.

As illustrated in FIGS. 2 and 4 the bottom end of the drop pipe 54 is located above the molded hemispherical segment 26 which is in fluid communication with the sewer line. This feature eliminates the use of a transitional elbow fitting at the lower end of the drop pipe 54 and enhances the visibility in the area of the transition of the drop pipe 54 and the bottom located flume 26. This feature avoids hidden or blind spots and eliminates the need to disassemble the vertical drop to clear obstacles.

Having thus described and explained a novel manhole drop system in accordance with the invention its advantages can be appreciated. For example should a blockage occur in the drop pipe 54 the catch bowl 40 will simply overflow. Should a blockage develop in the flume area the drop pipe 54 will continue to drain and no failure in the system due to a blockage should cause the incoming feed pipe to back up. During periods of low flow contact with the fluid path is minimal thus avoiding a collection of solids and grease. During higher flows, the open bowl-funnel of the catch bowl 40 encourages the development of smooth laminar swirl, which self-washes and promotes the appropriate directional changes from horizontal to vertical with minimal turbulence, thus reducing the opportunity to release gases.

Variations from the illustrated embodiment can be made by one skilled in the art without departing from the scope of the invention as determined by the following claims. For example the catch bowl could have a different shape that does not necessarily conform to the wall of the manhole and still have an upper portion shaped to reveal the exit port and the discharge opening and catch the fluid from the incoming feed pipe 18.

I claim:

1. A sewer conduit drop structure for a manhole wherein a side feed terminates at a discharge opening in the wall of the manhole where the discharge opening is at a level that is above a sewer line accessible at the bottom of the manhole, comprising:

an integral catch bowl having a fluid retaining wall, a front surface and a front opening therein, said fluid retaining wall having a bottom located exit port surrounded by the fluid retaining wall;

said fluid retaining wall having an upper portion thereof removed to expose the discharge opening in the manhole wall and the exit port for visual inspection thereof while being sized and shaped to capture sewer discharged fluid from a side feed pipe whose discharge opening is so spaced so as to expose the fluid from the discharge opening and channel the captured fluid towards the bottom located exit port.

2. The sewer conduit drop structure as claimed in claim 1 wherein said catch bowl has a front surface shaped to conform to the shape of a portion of the manhole wall at its discharge opening so as to be attachable to the manhole wall in a fluid tight manner and capture sewer fluid from the discharge opening.

3. The sewer conduit drop structure as claimed in claim 1 wherein said fluid retaining wall has a rearward portion shaped to reveal the discharge opening in the manhole wall from a sight line that is generally in alignment with the side feed at the manhole.

4. The sewer conduit drop structure as claimed in claim 2 wherein the front surface has a front flange extending parallel with the manhole wall alongside front surface opening and the discharge opening to provide a sewer fluid sealing attachment segment to affix the catch bowl to the manhole wall.

5. The sewer conduit drop structure as claimed in claim 1 wherein said fluid retaining wall has an upper portion removed therefrom so as to reveal the discharge opening in the manhole wall from a sight line that is generally in alignment with the side feed at the manhole and reveal the bottom located exit port for inspection from an upper opening in the manhole.

6. The sewer conduit drop structure as claimed in claim 1 and further including a sewer pipe and a pipe coupling sized to engage the catch bowl at its bottom located exit port and said sewer pipe; fasteners to affix the pipe to said manhole wall, said sewer pipe being sufficiently long to guide sewer fluid caught by the catch bowl to the sewer line at the bottom of the manhole.

7. A sewer conduit drop structure for a manhole wherein a side feed terminates at a discharge opening in the wall of the manhole where the discharge opening is at a level that is above a sewer line accessible at the bottom of the manhole, comprising:

an integral catch bowl having a fluid retaining wall, a front surface and a front opening therein, said fluid retaining wall having a bottom located exit port surrounded by the fluid retaining wall;

said fluid retaining wall having an upper portion thereof removed to expose the discharge opening in the manhole wall and the exit port for visual inspection thereof while being sized and shaped to capture sewer discharged fluid from a side feed pipe whose discharge opening is so spaced so as to expose the fluid from the discharge opening and channel the captured fluid towards the bottom located exit port;

a drain pipe connected to the catch bowl and coupled to the exit port thereof to channel captured fluid to the sewer line; and an open flume located in alignment with the drain pipe, said open flume being coupled to said sewer line to transfer fluid thereto.

* * * * *